US005570885A

United States Patent [19]

Ornstein

[11] Patent Number: 5,570,885

[45] Date of Patent: Nov. 5, 1996

[54] ELECTRONIC GAMING SYSTEM AND METHOD FOR MULTIPLE PLAY WAGERING

[76] Inventor: Marvin A. Ornstein, 605 Porter St., Ocean Springs, Miss. 39564

[21] Appl. No.: 391,051

[22] Filed: Feb. 21, 1995

[51] Int. Cl.[6] ..... A63F 1/00; A63F 1/18; A63F 5/00; G07F 17/34

[52] U.S. Cl. ..... 463/27; 463/17; 463/37; 463/31; 463/46

[58] Field of Search ..... 273/292, 274, 273/309, 85 CP, 138 A, 193 R

[56] References Cited

U.S. PATENT DOCUMENTS

| | | | |
|---|---|---|---|
| 4,614,342 | 9/1986 | Takashima | 273/85 CP |
| 4,861,041 | 8/1989 | Jones et al. | 273/292 |
| 5,078,405 | 1/1992 | Jones et al. | 273/309 |
| 5,098,107 | 3/1992 | Boylan et al. | 273/292 |
| 5,106,091 | 4/1992 | Comito | 273/142 H |
| 5,159,549 | 10/1992 | Hallman, Jr. et al. | 364/412 |
| 5,288,077 | 2/1994 | Jones | 273/292 |
| 5,342,047 | 8/1994 | Heidel | 273/85 CP |
| 5,364,104 | 11/1994 | Jones et al. | 273/292 |
| 5,382,025 | 11/1995 | Sklansky et al. | 273/292 |
| 5,490,670 | 2/1996 | Hobert | 273/138 A |

OTHER PUBLICATIONS

The Fresno Bee, "Blackjack introduced at Table Mountain" by Royal Calkins, Nov. 10, 1992.

*Primary Examiner*—Benjamin H. Layno
*Attorney, Agent, or Firm*—Louis Weinstein

[57] ABSTRACT

An electronic gaming system includes a processor and game progress monitor to allow a player to wager varying amounts on whether that player will have multiple consecutive wins of the game of chance. The system can be incorporated in a gaming table with multiple player video screens and bet selectors or in a single play slot machine type device.

41 Claims, 8 Drawing Sheets

ELECTRONIC GAMING SYSTEM AND METHOD FOR MULTIPLE PLAY WAGERING

BACKGROUND OF THE INVENTION

This invention relates generally to games of chance such as would be found in casinos and other legal gambling establishments and more particularly to electronic gaming systems which can be used to play blackjack, roulette, craps, and baccarat.

In those areas of the United States and the rest of the world where gambling is legal, there is a constant demand and need for new or improved games of chance to attract gamblers to casinos and other gambling establishments. At the same time, experienced gamblers have become familiar with traditional games of chance and gaming machines such as slot machines, blackjack tables, roulette tables, baccarat tables, and crap tables. Therefore, it is desirable that any new gambling machine or system take advantage of this familiarity.

One technique that can be used to increase the attraction of games of chance and lengthen the time in which the gamblers will stay at a particular gaming table or casino is to base the player's ultimate winning payoff not just on a single play of a game but on their success on repeated plays. In other words, a player may increase his or her payoff odds by winning the game five or ten consecutive times. Unfortunately, using prior art gaming tables and systems, there has not been an efficient way for casinos and casino dealers to keep track of consecutive wins or losses by a player at a particular time in order to readily determine and calculate payoffs based on successive wins or losses.

What is needed, then, is a gaming system which can accommodate one or more gamblers while allowing for multiple play wagering, that is where the player receives an ultimate payoff based upon achieving a pre-selected number of consecutive wins at the game of chance. Such a system is lacking in the prior art.

SUMMARY OF THE INVENTION

One object of the of the present invention is to provide an electronic gaming system that allows a gambler to receive an enhanced payoff based on achieving a pre-determined number of consecutive wins at a game of chance.

Another object of the electronic gaming system of the present invention is to allow multiple players at a gaming table to place bets based on a number of consecutive wins or losses and to monitor the progress towards winning such bets.

Yet another object of the electronic gaming system of the present invention is to provide a system for consecutive game wagering that can be used at both multiple player gaming tables and at individually operated slot machine type devices.

In accordance with these and other objects which will become apparent below, the electronic gaming system of the present invention is based on a microprocessor and game win/lose monitor which allows the system to keep track of an individual player's consecutive wins or losses. The system can be used to play conventional games of chance, such as blackjack, roulette, baccarat, and craps. The system can be incorporated within a conventional gaming table, such as blackjack, in which each player's seating area at the table is provided with a player-specific bet selection device and player video screen. The bet selection device is used by the player to electrically indicate to the processor how may consecutive wins that player believes he will win in order to receive an enhanced payoff based on predetermined odds. A player can also select a bet value which, in accordance with one preferred embodiment of the system, is entered by the dealer at the table on a computer touch screen interface adjacent to the dealer area.

After the bet is selected and value entered, the player begins to play the game of chance, following the usual rules. The video screen adjacent to the player's seating area, preferably a back-lit LCD, indicates to the player the dollar amount of the bet, the type of bet selected, and the number of consecutive wins achieved by that player towards the bet selected. A game progress monitor associated with the processor of the system allows the dealer to keep track of consecutive wins by each player through the touch screen interface. When the number of consecutive wins equals the amount preselected by the player, the player's screen is activated and the payoff made. If the player loses the game of chance before achieving the number of pre-selected consecutive wins, this can be indicated to the player by removing the backlighting from the player's screen.

In another embodiment of the invention, the system is incorporated in a slot machine type device for use by a single player. The player selects the value of his bet by inserting cash, tokens, or chips in currency slots disposed through the front panel of the device, which sends an electrical signal to the processor indicating the dollar amount. The player also reviews a graphic display on the front of the device, indicating the rules of play and the predetermined odds based on the number of consecutive wins achieved. The player then, through a bet selector switch panel, selects a number of consecutive wins desired by the player in order to achieve an enhanced payoff. The game play is then activated by pulling the manual pull handle switch.

A character generator associated with the processor generates electronic blackjack characters, such as blackjack cards, on the character display integral to the front panel of the slot machine device. The player then has an opportunity to electrically indicate to the processor whether an additional card "hit" is desired, or if the player wants to "stand" with no additional cards, and the game continues. The game progress monitor associated with the processor electronically monitors consecutive wins or losses and if the number of wins selected preselected by the player is achieved, the win signal lamp is activated and payoff is received from the device through a currency bin, in a conventional manner. In instances where the payoff amount is above a certain level established by the casino or if a tax ID number is needed, the player may need to obtain the payoff funds from the casino directly.

DESCRIPTION OF THE PREFERRED EMBODIMENTS

Figure 1:
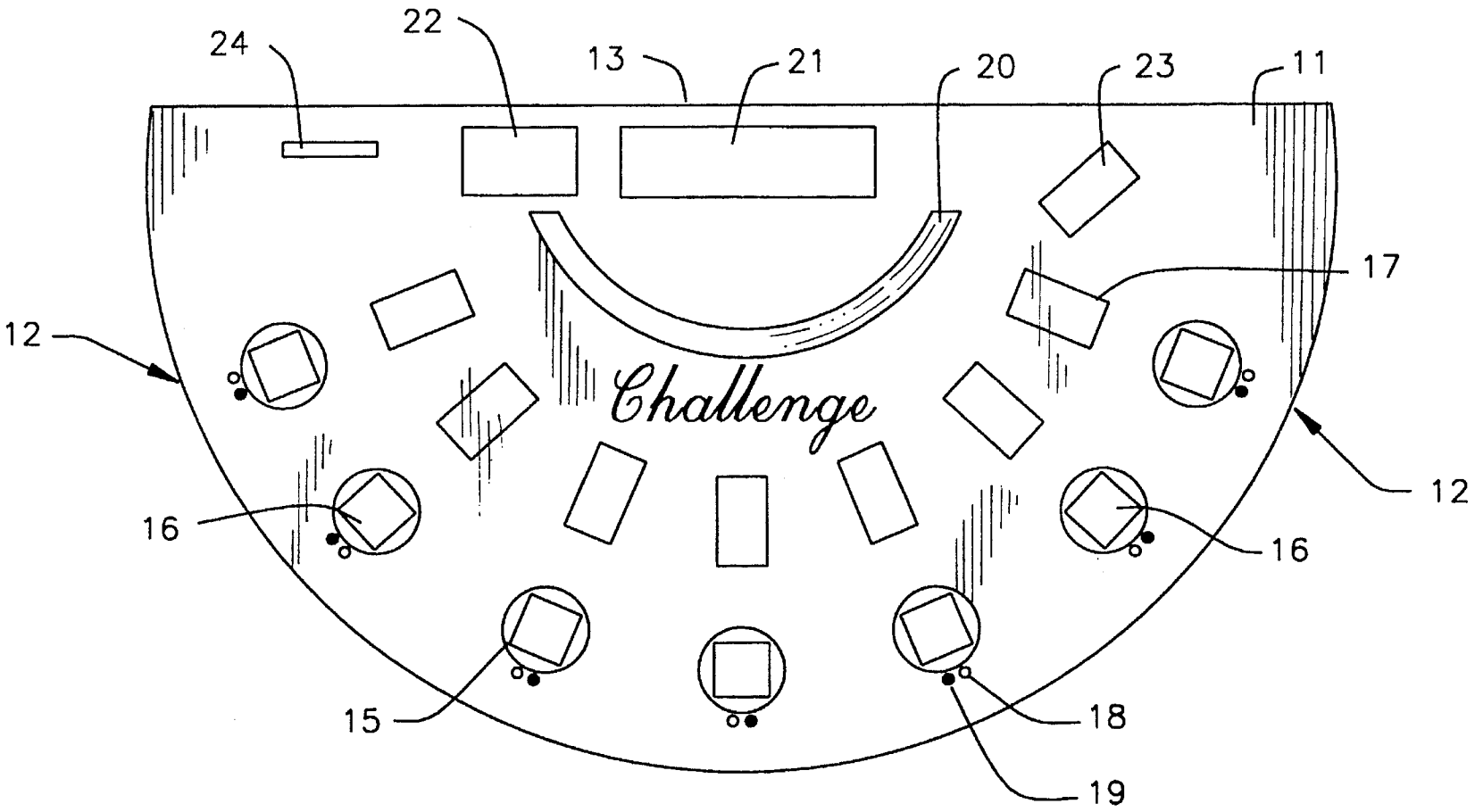
FIG. 1 is a plan view of a first embodiment of the system of the present invention in which the game of chance is blackjack played at a multiple player blackjack table.
Figure 7:
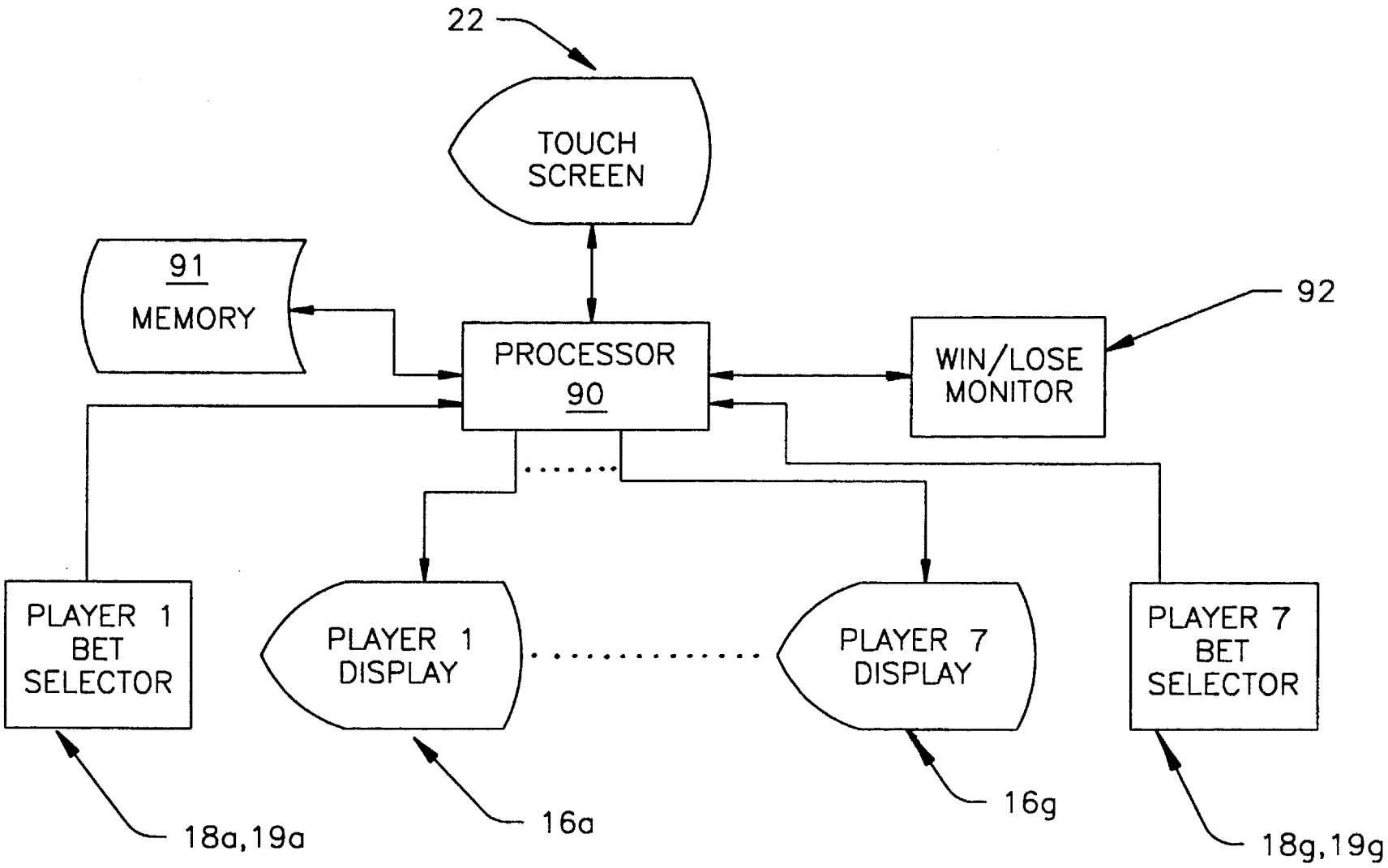
FIG. 7 is a block diagram of the system of the present invention as implemented in the embodiment of FIGS. 1, in which the game of chance is blackjack played at a blackjack table.

Referring to FIGS. 1 and 7 of the drawings, a first embodiment of the electronic gaming system is shown. In this embodiment, the game of chance is blackjack, a game having rules and objectives well known to those skilled in the art as well as those in the gambling community as a whole. In gambling casinos, blackjack is conventionally played at a blackjack table 11 having multiple player seating areas 12 to allow more than one player to gamble at single table 11. The game is run by a dealer who stands in the dealer area 13. The dealer area 13 and multiple player seating areas 12, including the players' betting squares 17 are physically separated by a divider 20 to eliminate the risk of accidental mixing of the dealer cards and player cards. The betting squares 17 are where each player places his chips representing his conventional blackjack bet. Placed within or immediately adjacent to each player seating area 12 is a betting circle 15 which incorporates a player video display 16 and first and second bet selector switches 18 and 19. In accordance with one of the novel features of this system, bet selector switches 18 and 19 allow each player to electronically communicate to the system a certain number of consecutive wins of blackjack which must be achieved by that player in order to win an enhanced payoff amount. For example, first bet selector switch 18 will signal to the system that the player desires to receive an enhanced payoff upon achieving five consecutive wins, with second bet selector switch 19 corresponding to ten consecutive wins. Enhanced consecutive win payoff odds are posted on or near blackjack table 11, and even displayed on player video screen 16, for example, stating the odds corresponding to a certain number of consecutive wins.

Prior to selecting the number of consecutive wins, the player places a number of chips, representing currency, within betting circle 15 up to the maximum bet amount allowed by that casino. This bet amount is then entered into the system, preferably by the dealer using a conventional touch screen computer interface 22. On touch screen computer interface 22 will be displayed an icon corresponding to each player position 12, with related icons representing the dollar amount of the chips placed by each player within their corresponding betting circle 15. Of course, the player also determines the amount of his conventional blackjack bet for each game and places those chips in betting square 17.

Once the dollar amount and type of bet is placed, the information is electronically communicated to processor 90 and stored in conventional memory unit 91. Concurrently, player video screen 16 will then display the dollar amount of the bet placed, the consecutive number of wins selected, and when play begins, the consecutive number of wins achieved.

Play then begins by the dealer dealing the player's cards in front of each player and dealer cards to himself in front of chip rack 21. The first game of blackjack proceeds in conventional manner with winners being declared in accordance with the rules of the game. At the conclusion of the first game, the dealer enters information at touch screen 22 as to whether a particular player has won or lost. That win and loss information is then monitored in conjunction with processor 90 by win/lose monitor 92 (FIG. 7). If a particular player has won, information is displayed at that player's video screen 16. If a particular player has lost that game, such information is so indicated at the player's video screen 16, such as by darkening of the screen. Play then proceeds to the next game. Processor 90, in conjunction with memory unit 91 and win/lose monitor 92, compares after each game the number of consecutive wins by a single player to the number of pre-selected consecutive wins selected by that player prior to the first game, by using player bet selector switches 18 and 19. When the number of actual consecutive wins achieved equals the number of pre-selected consecutive wins, processor 90 declares that player a winner and indicates such at dealer touch screen monitor 22 as well as that player's video screen 16. The dealer then makes an enhanced payoff to that player in accordance with a payoff calculation made by processor 90, based on pre-programmed odds corresponding to the number of consecutive wins and as a function of the dollar value of the bet placed by that player before play begin.

Table 11 also has a card shoe 23 for holding one or more decks of cards used by the dealer during play and a conventional drop box 24 used by the dealer to hold cash, credit and debit slips, and the like.

Figure 2:
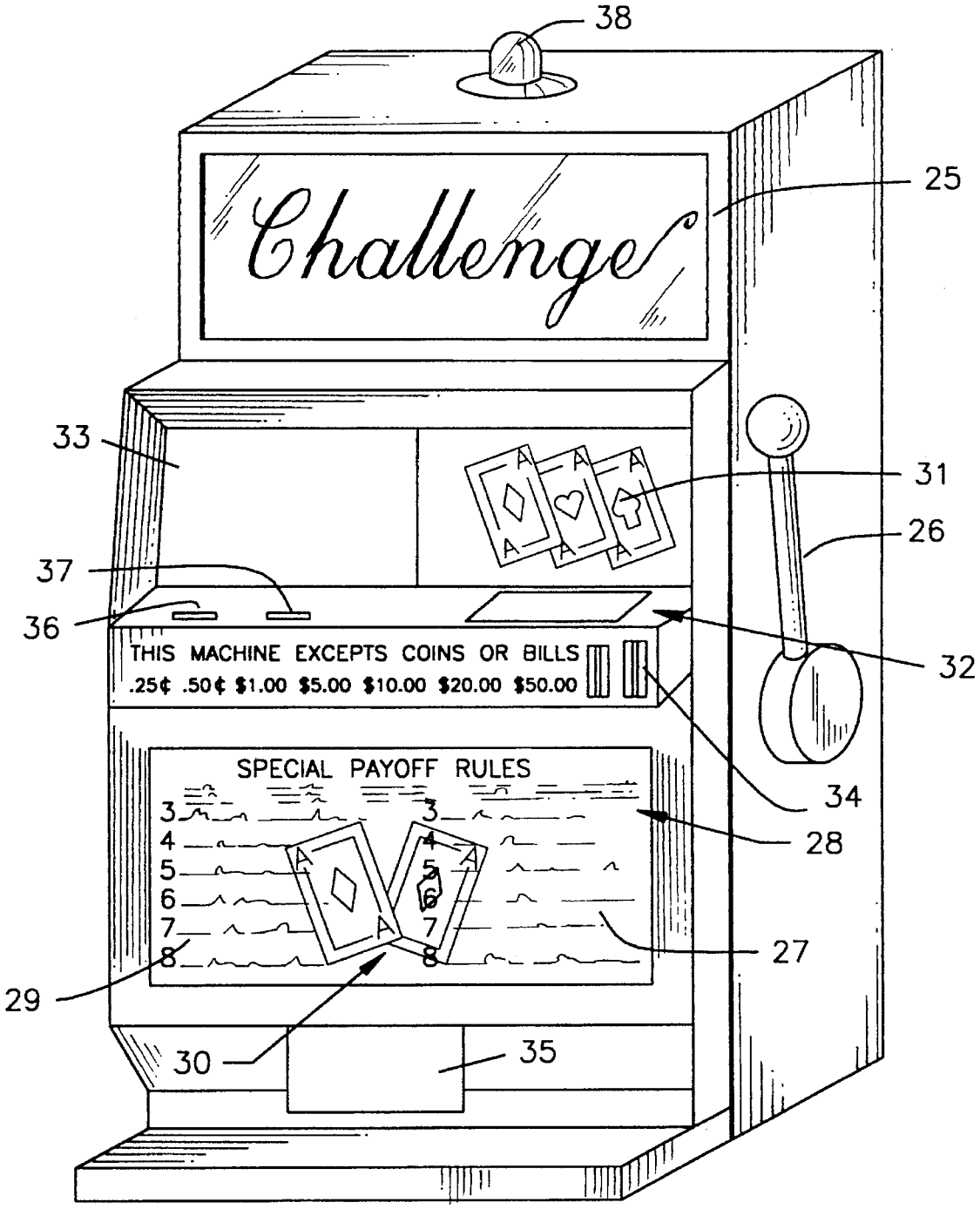
FIG. 2 is a front perspective view of a second embodiment of the system of the present invention in which the game of chance is blackjack played at a single player slot machine type device.
Figure 8:
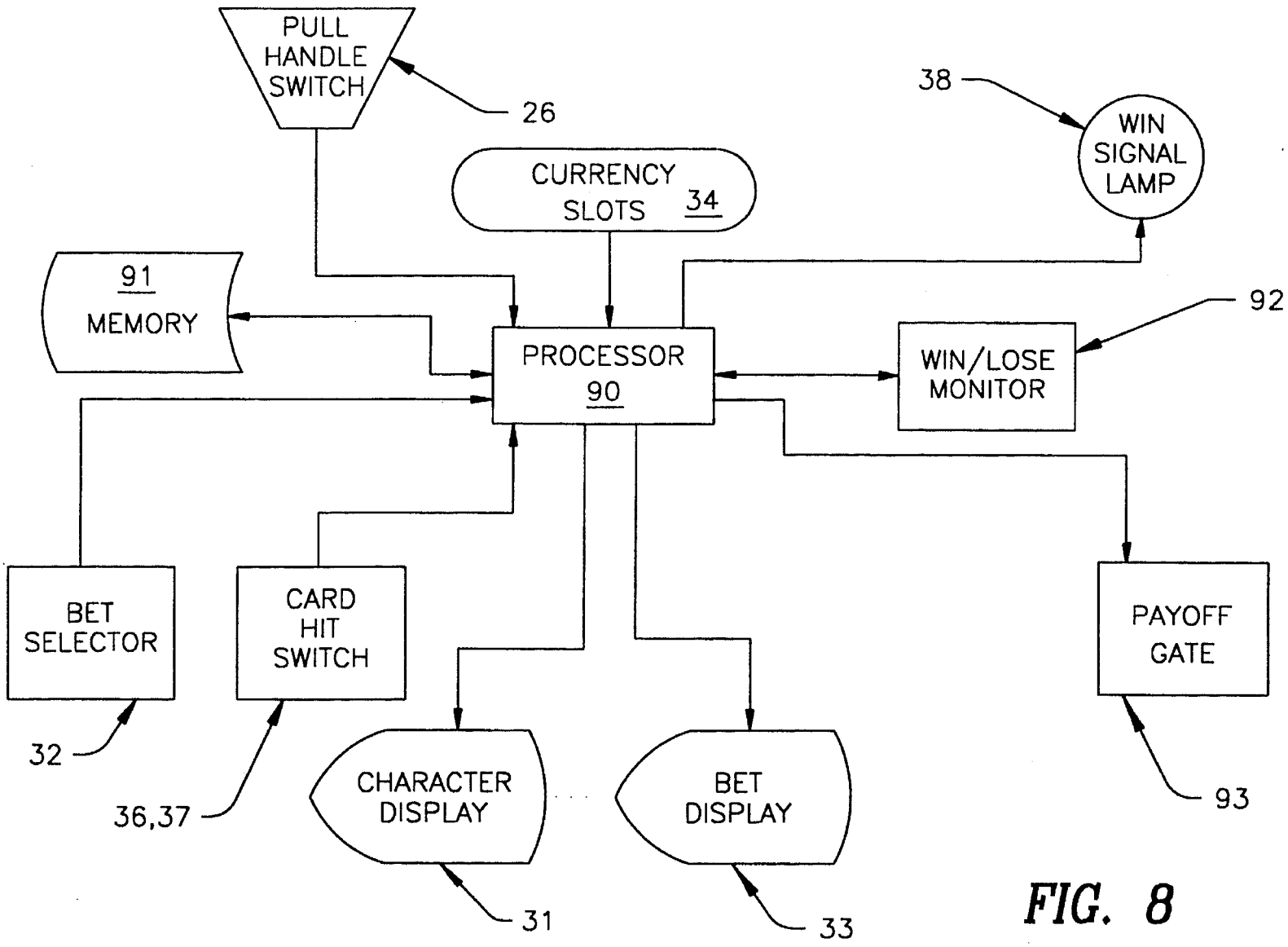
FIG. 8 is a block diagram of the system of the present invention as implemented in the embodiment of FIG. 2 in which the game of chance is blackjack played at a slot machine device.

FIGS. 2 and 8 illustrate a second embodiment of the system in which the game of chance is blackjack, but played by single player at a game system incorporated within a slot machine type device 25. Device 25 includes a mechanical handle 26 which operates an internal electrical switch to activate the system. A graphic display panel 27 on the front of device 25 provides the player with the special payoff rules (in are 28) corresponding to the novelty of the system along with the varying odds (in area 29) corresponding to a number of consecutive wins, 3 through 14, for example. Decorative artwork 30, such as playing cards, can be included within graphic display 27 to increase the visibility of device 25.

After reading the rules, the player inserts bills, coins or chips into one or more currency slots 34 which are placed through the front panel of device 25. Electrical switch devices (not shown) internal to each slot 34 then signal to processor 90 indicating the value of the bet. Also mounted on the front panel of device 25 is a bet selector switch panel 32 which contains one or more bet selector switches to allow the player to electrically indicate to processor 90 how many consecutive wins the player needs to achieve in order to receive an enhanced payoff.

Once the bet value and bet type are selected, the player then pulls handle 26, which electrically activates the system. A character generator associated with processor 90 generates an electronic blackjack card for the dealer and the player's first two blackjack cards and displays them to the player on character display 31. At this point, and again in accordance with the conventional rules of blackjack, the player makes a decision as to whether he desires an additional card and if so, sends a signal to processor 90 to that effect by pressing card hit switch 36 on the front panel of device 25. Otherwise, player presses no hit switch 37 immediately adjacent thereto. The dealer's second electronic blackjack card then appears on character display 31, after being randomly generated by the character generator associated with processor 90. The play continues until the player wins or in accordance with the rules of the game.

Win/lose monitor 92 in conjunction with processor 90 and memory unit 91, keeps track of consecutive wins by the player and then displays the number of consecutive wins on display panel 33 on device 25. When the player achieves the number of consecutive wins pre-selected by the player, processor 90 causes win lamp 38 to illuminate while simultaneously sending an electrical signal to payoff gate 93. Again in a conventional manner known to those skilled in the art of slot machine design, this causes device 25 to dispense the calculated payoff through bin 35 from the currency supply internal to device 25. Again, as in the first embodiment, processor 90 calculates the payoff amount using the dollar value of the bet selected by the player, as a function of the odds corresponding to the number of consecutive wins selected and achieved by the player. The processor 90 can also be programmed to require the player to obtain a manual payoff from the casino if the size of the payoff exceeds a preset limit or if a tax ID number is needed.

Figure 3:
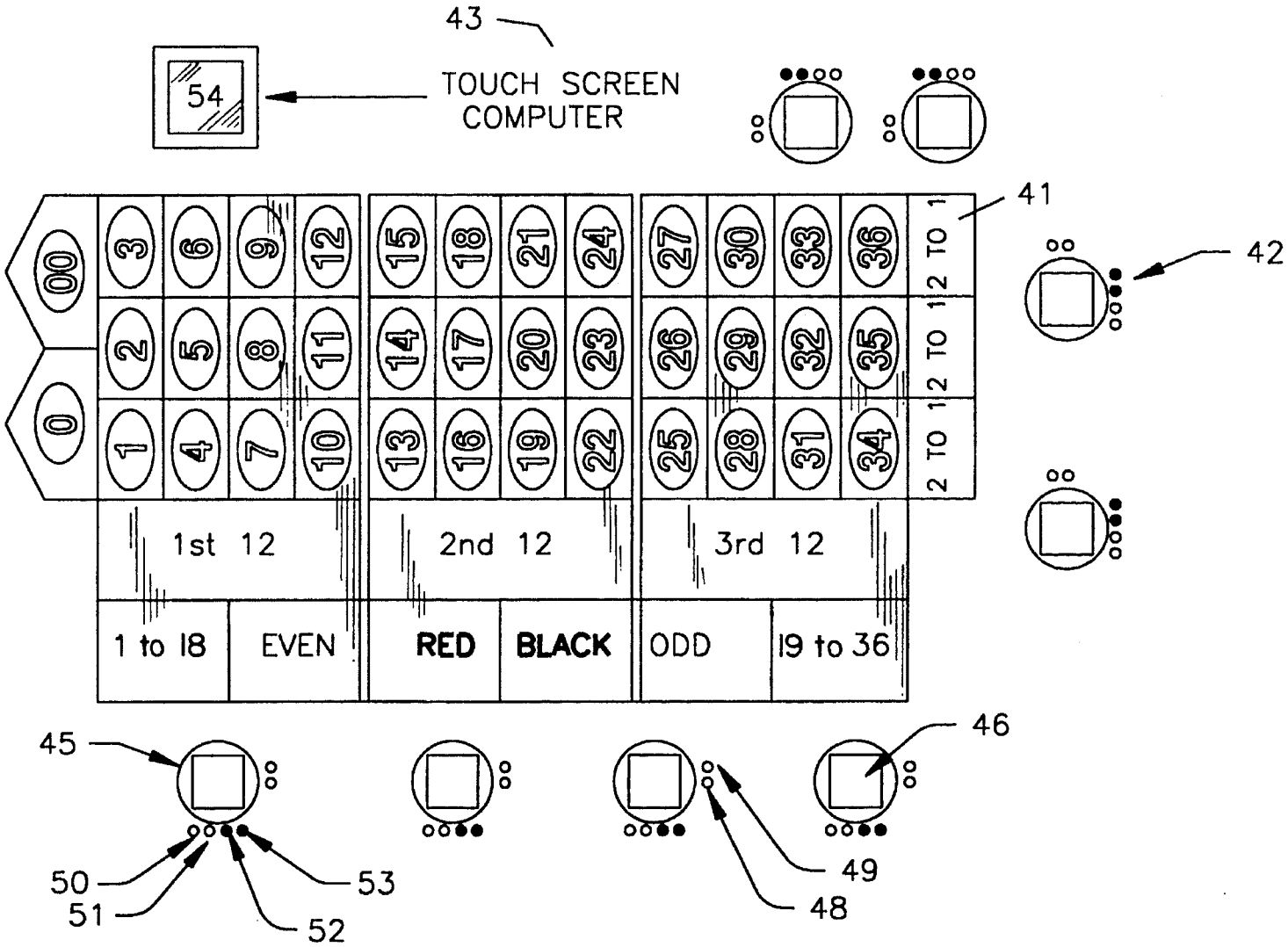
FIG. 3 is a plan view of a third embodiment of the system of the present invention in which the game of chance is roulette played at a roulette table.

FIG. 3 illustrates a third embodiment of the system in which the game of chance is roulette, played at a roulette table 41. Placed around table 41 are multiple player seating areas 42 and a dealer area 43. Adjacent to each player seating area 42 are betting circles 45 which incorporate individual player video screens 46 and first and second bet selector switches 48 and 49. Bet selector switches 48 and 49 are used by the player to indicate to the system and processor 90 (similar to that described with respect to FIG. 7) how many consecutive wins of roulette are preferred by the player in order for the player to receive an enhanced payoff amount. Because in this embodiment the game of chance is roulette, four additional bet switches 50, 51, 52, and 53 are also placed on table 41 adjacent to each player seating area 42. Preferably, switch 50 allows the player to indicate to the system whether an even bet is preferred while switch 51 would indicate an odd bet. Similarly, switches 52 and 53 allow the player to indicate to the system whether a black or red bet is preferred.

The player must also select a dollar amount of the bet by placing chips inside betting circle 45, and that information is entered into the system and processor 90 as well as memory unit 91 (FIG. 7) through touch screen 54 located adjacent to dealer area 43.

After the type and dollar amount of the bet is selected, the play begins in conventional manner. Win/lose monitor 92 (FIG. 7) keeps track of each player's consecutive wins based on the type of bet selected by the player using bet switches 50, 51, 52, or 53. When win/lose monitor 92 and processor 90 determine that the number of consecutive wins equals that pre-selected by the player prior to commencement of play, the player is notified at that player's video screen 46. The enhanced payoff is then received from the dealer. If the player loses his bet prior to achieving the pre-selected number of consecutive wins, the player's video screen 46 goes blank.

Figure 4:
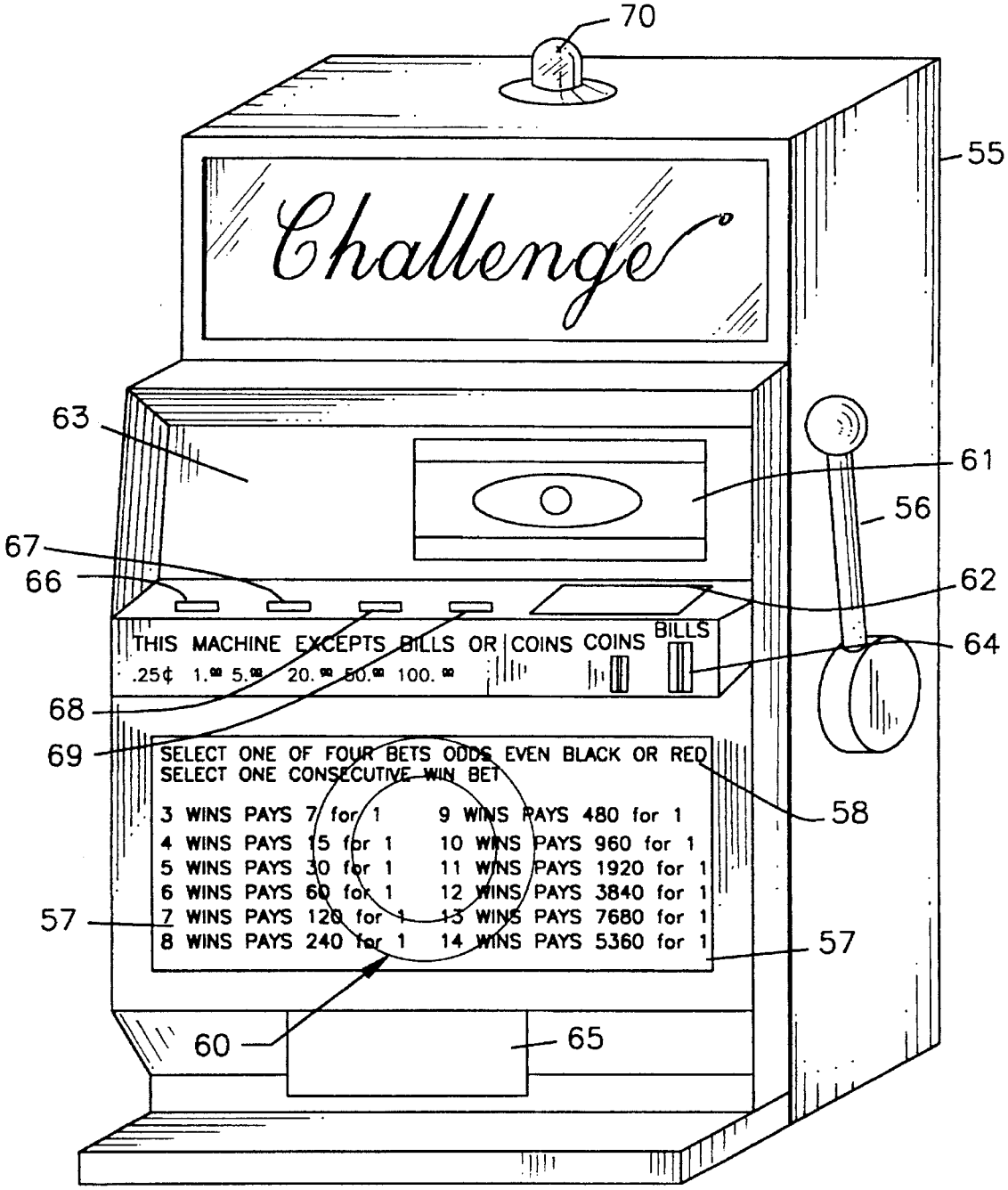
FIG. 4 is a front perspective view of a fourth embodiment of the system of the present invention in which the game of chance is roulette played at a slot machine type device.

FIG. 4 shows a fourth embodiment of the system in which the game of chance is roulette but played at a single player slot machine device 55. The graphic display 57 on the front panel of device 55 explains the betting rules at section 58 and the various enhanced payoff odds at section 57. The decorative portion 60 can be used to attract gamblers to device 55 by indicating that it is a roulette type device.

Using currency slots 64, the player indicates to the system the dollar value of the bet desired as described above. The player also selects an odd bet, an even bet, a black bet, or a red bet using bet switches 66, 67, 68, or 69, respectively, on the front panel of device 55. Finally, the player uses bet selector switch panel 62 to communicate to the system how many consecutive wins the player desires to achieve in order to win an enhanced payoff according to the odds shown on portion 59 of graphic display 57.

The player then activates the system by pulling pull handle 56. This causes the character generator in the system to randomly generate a roulette number (odd or even, red or black) and display that number on electronic number display 61. If the player wins, the number of consecutive wins is electronically displayed on screen 63 on the front panel of device 55. Win/loss monitor 92 (FIG. 8) in conjunction with processor 90 keeps track of the number of consecutive wins and compares that pre-determined number entered by the player at bet selector switch panel 62. If the number of consecutive wins achieved equals the pre-determined number entered by the player, processor 90 causes the win signal lamp 70 to illuminate and dispenses the enhanced payoff amount through payoff bin 65, unless the size or multiple of the payoff is pre-programmed to require a visit to the casino cage for payoff or determining the player's tax ID number.

Figure 5:
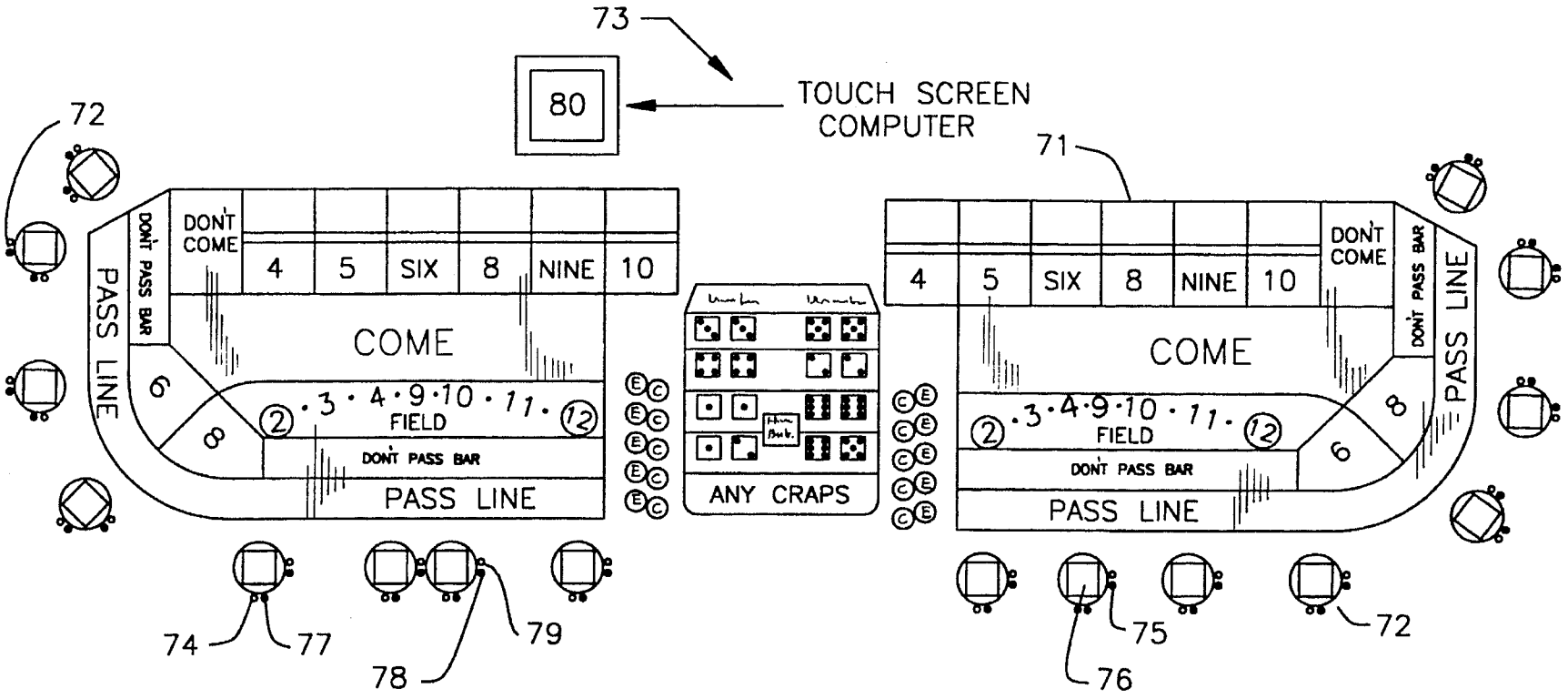
FIG. 5 is a plan view of a fifth embodiment of the system of the present invention in which the game of chance is craps.

FIG. 5 is a fifth embodiment of the system where the game of chance is craps played at a craps table 71. Similar to the blackjack and roulette tables described above, a conventional craps table 71 is modified by distributing a plurality of betting circles 75 and placing them at each multiple player seating area 72. Each special betting circle 75 includes a player video screen 76 adjacent to first and second bet selector switches 78 and 79, which are used by the player to determine how many consecutive wins or losses are needed in order to achieve an enhanced payoff. In the game of craps, and in this embodiment of the system, the player also has the choice of indicating whether the player believes he will win or lose and so indicating by manipulation of player win selector switch 74 or player loss selector switch 77. Thus, the player can achieve an enhanced payoff by telling the system whether he believes he will win or lose that game in a consecutive manner. Of course, the dollar amount of the bet is signified by the player placing his chips within betting circle 75 and entered by the dealer into the system through computer touch screen 80, adjacent to dealer area 73. Consecutive wins and/or losses are monitored by the system as described above.

Figure 6:
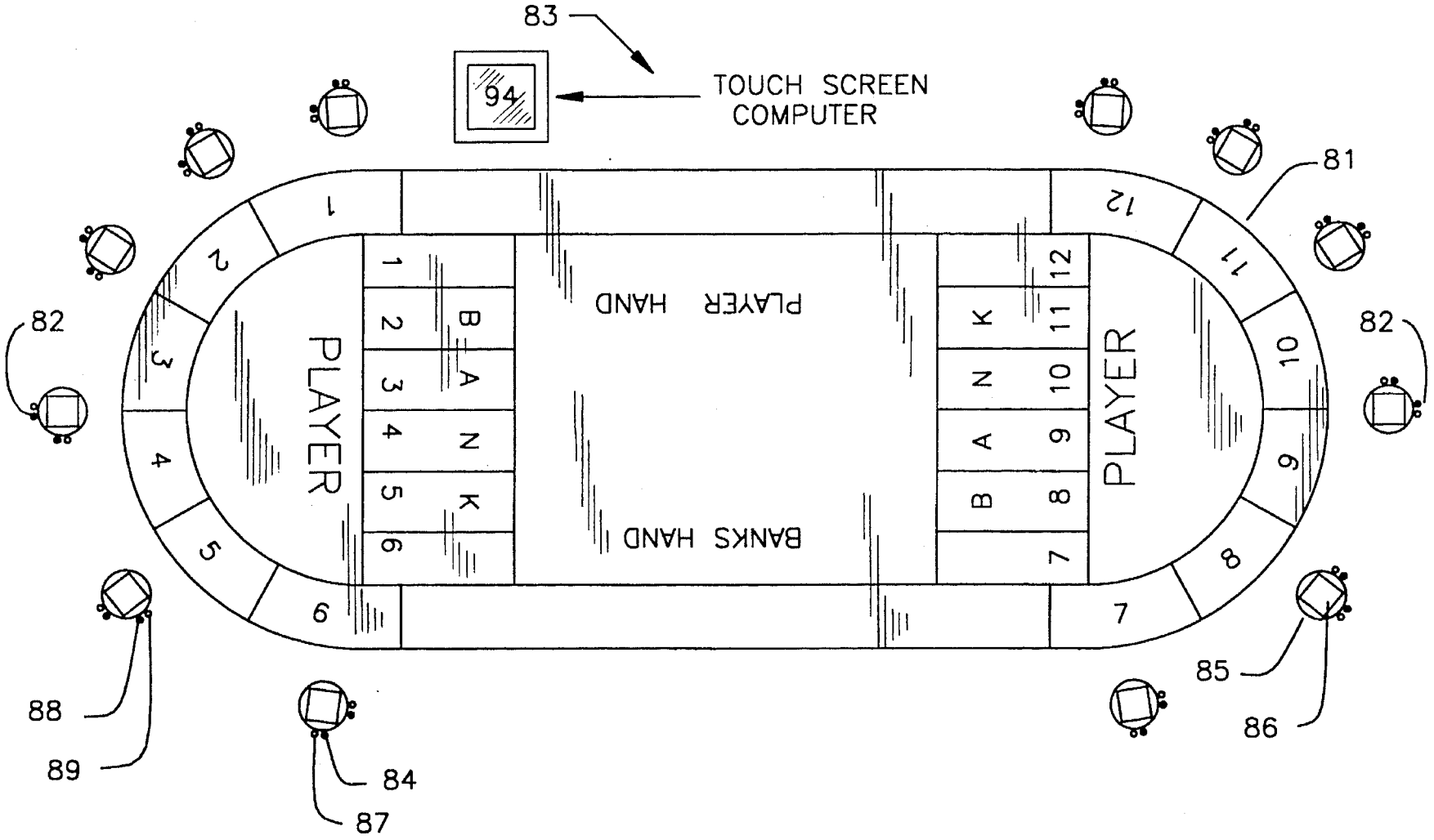
FIG. 6 is a plan view of a sixth embodiment of the system of the present invention in which the game of chance is baccarat.

FIG. 6 shows a sixth embodiment of the system in which the game of chance is baccarat, played at a baccarat table 81, having multiple player seating areas 82 distributed around table 81 and a dealer area 83. Each player seating area 82 has a special betting circle 85, which includes a player specific video screen 86. First and second bet selector switches 88 and 89 are used by the player to communicate to the processor 90 how many consecutive wins are desired in order to achieve an enhanced payoff. However, in the game of baccarat, the player has the option of indicating to the system whether he believes that the player will win, by using switch 87, or that the bank will win, by using switch 84. The dollar amount of the bet is signified by the player by placing the desired number of chips within betting circle 85. The dealer records the values of the bets by means of touch screen 94.

Thus, although there have been described particular embodiments of the present invention of a new and useful electronic gaming system for multiple play wagering, it is not intended that such references be construed as limitations upon the scope of this invention except as set forth in the following claims.

What I claim is:

1. An electronic system for playing a game of chance having a plurality of plays wherein a win or a loss is determined after each play of the game, the system comprising:

a. a game enclosure, the enclosure including a player interface means for at least one player to physically interact with the system;

b. bet value entry means for generating a bet value signal to the system, the bet value signal representing a dollar amount of a bet placed by a player prior to commencement of the player's first of a consecutive number of plays of the game;

c. bet selector means for generating a bet selection signal to the system, the bet selection signal including information representing a prospective number of consecutive play wins of the game to receive a payoff from the system, the number of prospective consecutive play wins being selected by the player prior to commencement of a player's fist play of the of the game;

d. play progress monitoring means for electronically recording a number of actual consecutive play wins of the game achieved by the player;

e. player display means for visually indicating to the player the dollar amount of the bet placed by the player, the number of prospective consecutive play wins selected by the player, and the number of actual consecutive play wins achieved by the player; and f. processor means for comparing the bet selection signal to the actual number of consecutive play wins recorded by the play progress monitoring means and for generating a player pay off signal when the number of actual consecutive play wins equals the number of prospective consecutive play wins selected by the player, the processor means being electrically connected to the player display means, to the bet value entry means, to the bet selector means, and to the play progress monitor means.

2. An apparatus for playing a game of chance, having a plurality of plays wherein a win or a loss is determined after each play of the game, comprising:

means for receiving at least one betting member representing a monetary amount of a bet placed by a player prior to commencement of the player's first of a consecutive number of plays of the game;

bet selector means for selecting a number of consecutive play wins chosen by the player from among a set number of choices;

means or determining a payoff based upon a number of consecutive play wins and the monetary amount of the bet selected by the player;

means for accumulating a number of consecutive play wins of the game achieved by the player; and means responsive to said bet selector means and accumulating means for visually indicating to the player the number of consecutive play wins chosen by the player, the payoff based upon the number of consecutive play wins and the monetary amount of the bet selected by the player, and the number of actual consecutive play wins achieved by the player, and for providing a consecutive play win indication when the selected number of wins is equal to the number of consecutive play wins achieved by a player.

3. The apparatus of claim 2 wherein the game of chance is Blackjack.

4. The apparatus of claim 3 further comprising a table, and a plurality of player seating areas around the periphery of the table, the table further comprising a dealer area.

5. The apparatus of claim 4 wherein the bet selector means comprises a plurality of displays arranged on the table, each display being adjacent one of the player seating area.

6. The apparatus of claim 5 wherein the bet selector means further comprises a plurality of manually operated members, at least one such member being adjacent each of the player seating areas.

7. The apparatus of claim 2, further comprising memory means electrically connected to a processor means for storing data representing the odds for each selectable number of consecutive play wins, said determining means calculating a payoff amount as a function of the number of consecutive play wins selected utilizing payoff data odds stored in said memory means and monetary value of the consecutive play wins bet.

8. The apparatus of claim 2 wherein the game of chance comprises one of a slot machine and video game having a pull handle for initiating a game, and a display on a front of the slot machine containing system rules and payoff odds.

9. The apparatus of claim 8, wherein the means for receiving comprises at least one slot along the surface of the slot machine.

10. The apparatus of claim 9, the bet selector means comprising at least one manually operable member mounted along a surface of the slot machine.

11. The system of claim 10, further comprising memory means for storing pre-programmed payoff odds which correspond to different values of the prospective consecutive play wins, and the processor means further comprising payoff calculator means for calculating player payoff amounts as a function of the pre-programmed payoff odds and amount bet.

12. The apparatus of claim 10, further comprising memory means coupled to the processor means for storing data representing the odds for each selectable number of consecutive play wins, said determining means calculating a payoff amount as a function of data representing a number of consecutive play wins selected and a monetary value of the consecutive play wins bet.

13. The apparatus of claim 12 further comprising means inside the slot machine for dispensing a payoff amount responsive to a consecutive wins indication.

14. The apparatus of claim 2, wherein the game of chance is Roulette.

15. The apparatus of claim 14 further comprising a Roulette table, having a plurality of player seating areas around the periphery of the table, the table further comprising a dealer area, and the bet selector means further comprising means for selecting a consecutive number of wins of either odd or even or red or black.

16. The apparatus of claim 15 wherein the bet selector means further comprises a plurality of displays arranged on the table, each display being adjacent each of the player seating areas.

17. The apparatus of claim 16 wherein the bet selector means further comprises a plurality of manually operated members, at least one of the members adjacent each of the player seating areas.

18. The system of claim 14 further comprising memory means for storing pre-programmed payoff odds which correspond to different values of the prospective consecutive play wins, and said determining means further comprising payoff calculator means for calculating player payoff amounts as a function of the pre-programmed payoff odds and the bet value signal.

19. The system of claim 14 wherein the game enclosure comprises a slot machine device and the player interface comprises a pull handle switch for activating the system, the pull handle switch means attached to the slot machine device and electrically connected to the processor means, a graphic display containing system rules and payoff odds, the system further comprising character generator means for randomly generating electronic Roulette numbers, and the system further comprising character display means for visually displaying the electronic Roulette numbers, the character display means integral to the slot machine device and electrically connected to the character generator means.

20. The system of claim 19, the bet value entry means comprising a plurality of currency slots in the surface of the slot machine device.

21. The system of claim 20, the bet selector means comprising at least one bet selector switch mounted on the surface of the slot machine device and the bet selection signal further comprising information corresponding to whether an odd, even, red or black Roulette number selection is desired by the player.

22. The system of claim 21, further comprising memory means for storing pre-programmed payoff odds which correspond to different values of the prospective consecutive play wins, and the processor means further comprising payoff calculator means for calculating player payoff amounts as a function of the pre-programmed payoff odds.

23. The system of claim 22 further comprising means currency supply internal to the slot machine device for storing payoff currency and for delivering the calculated player payoff amount to the player in response to the player payoff signal.

24. The apparatus of claim 14, further comprising memory means coupled to the processor means for storing data representing the odds for each selectable number of consecutive play wins, said determining means calculating a payoff amount as a function of data representing a number of consecutive play wins selected and a monetary value of the consecutive play wins bet.

25. The apparatus of claim 14 wherein the game of chance comprises a slot machine or video game having an operating member for initiating a game, and a display on a front of the slot machine containing system rules and payoff odds.

26. The apparatus of claim 25, wherein the means for receiving comprises at least one slot along the surface of the slot machine.

27. The apparatus of claim 26, wherein the bet selector means comprises at least one manually operable member mounted along a surface of the slot machine.

28. The apparatus of claim 27, further comprising memory means coupled to the processor means for storing data representing the odds for each selectable number of consecutive play wins, said determining means calculating a payoff amount as a function of data representing a number of consecutive play wins selected and a monetary value of the consecutive play wins bet.

29. The apparatus of claim 28 further comprising means inside the slot machine for dispensing a payoff amount responsive to a consecutive play wins indication.

30. The apparatus of claim 2 wherein the game of chance is Craps, further comprising a Craps table having a plurality of player seating areas around the periphery of the table, the table further comprising a dealer area.

31. The apparatus of claim 2 wherein the bet selector means comprises a plurality of displays arranged on the table, one display being adjacent each of the player seating areas.

32. The apparatus of claim 31 wherein the bet selector means further comprises a plurality of manually operated members with at least one member adjacent each of the player seating areas.

33. The system of claim 30, further comprising memory means for storing pre-programmed payoff odds which correspond to different values of the prospective consecutive play wins, said determining means further comprising payoff calculator means for calculating player payoff amounts as a function of the pre-programmed payoff odds and the bet value signal.

34. The apparatus of claim 30, wherein the bet selector means comprising at least one manually operable member mounted along a surface of the slot machine.

35. The apparatus of claim 2 wherein the game of chance is Baccarat, and comprises a Baccarat table, having a plurality of player seating areas around the periphery of the table, the table further comprising a dealer area.

36. The system of claim 35 wherein the player display means comprises a plurality of video screens attached to the table, one of the video screens adjacent each of the player seating areas.

37. The system of claim 36, further comprising memory means for storing pre-programmed payoff odds which correspond to different values of the prospective consecutive play wins, said determining means further comprising payoff calculator means for calculating player payoff amounts as a function of the pre-programmed payoff odds and the bet value signal.

38. The apparatus of claim 35 wherein the bet selector means further comprises a plurality of displays arranged on the table, each display being adjacent each of the player seating areas.

39. The apparatus of claim 38 wherein the bet selector means comprises a plurality of manually operated members with at least one of the members adjacent each of the player seating areas, the bet selector means further comprising means for selecting information corresponding to whether a player win or bank win bet is desired by a player.

40. The apparatus of claim 35, further comprising memory means coupled to the processor means for storing data representing the odds for each selectable number of consecutive play wins, said determining means calculating a payoff amount as a function of data representing a number of consecutive play wins selected and a monetary value of the consecutive play wins bet.

41. A method of incorporating a consecutive win side bet into a game of chance having a plurality of plays wherein a win or a loss is determined after each play of the game comprising the steps of:

a) at least one player wagering a chip or coin representative of a side bet of a number of consecutive play wins;

b) said player making the wager of step (a) further selecting a number of consecutive play wins from within a permitted range of numbers;

c) presenting a display of the number of consecutive play wins selected by the player in step (b), a payoff amount according to the number of consecutive play wins selected by the player in step (b) and the amount of the wager made in step (a) and the number of actual consecutive play wins achieved by the player;

d) said player attempting to play a consecutive number of plays of the game in an attempt to win the number of consecutive play wins selected by the player in step (b);

e) providing a winning indication when the player making the side bet wager wins the consecutive number of plays of the game which is equal to the number of consecutive play wins originally selected; and f) cancelling the display when a player has lost a play of a game prior to achieving a number of consecutive plays of the game won equal to the consecutive number of plays of the game selected by the player.

* * * * *